US006737983B1

(12) United States Patent
Temple

(10) Patent No.: US 6,737,983 B1
(45) Date of Patent: May 18, 2004

(54) DISPLAY BOARD HAVING ILLUMINATED ELEMENTS AND METHOD

(76) Inventor: John Temple, 33520 J. Pl., Ocean Park, WA (US) 98640

( * ) Notice: Subject to any disclaimer, the term of this patent is extended or adjusted under 35 U.S.C. 154(b) by 189 days.

(21) Appl. No.: 09/693,724

(22) Filed: Oct. 20, 2000

Related U.S. Application Data

(60) Provisional application No. 60/161,683, filed on Oct. 26, 1999.

(51) Int. Cl.[7] ..... G08B 5/22

(52) U.S. Cl. ..... 340/815.45; 340/815.65; 340/907; 345/84; 345/214; 362/248; 362/294; 362/800; 362/806

(58) Field of Search ..... 340/815.45, 815.65, 340/907; 345/84, 214; 362/248, 294, 800, 806

(56) References Cited

U.S. PATENT DOCUMENTS 3,591,942 A * 7/1971 Van Swearingen ..... 40/615
3,758,972 A 9/1973 Egermayer
4,970,812 A 11/1990 Tanaka et al.
5,027,258 A 6/1991 Sconiger et al.
5,036,248 A 7/1991 McEwan et al.
5,268,828 A 12/1993 Miura
5,361,190 A 11/1994 Roberts et al.
5,450,301 A 9/1995 Waltz et al.
5,469,020 A 11/1995 Herrick
5,575,098 A 11/1996 Goettel-Schwartz
5,612,741 A 3/1997 Loban et al.
5,638,084 A * 6/1997 Kalt ..... 345/31
5,678,335 A 10/1997 Gomi et al.
5,836,676 A 11/1998 Ando et al.
5,900,813 A 5/1999 Ruminski et al.
5,900,850 A 5/1999 Bailey et al.
5,946,646 A 8/1999 Schena et al.
6,000,812 A 12/1999 Freeman et al.
6,101,750 A 8/2000 Blesener et al.
6,262,698 B1 * 7/2001 Blum ..... 345/55
6,271,814 B1 * 8/2001 Kaoh ..... 345/82
6,567,010 B1 * 5/2003 Lin et al. ..... 340/815.67

* cited by examiner

*Primary Examiner*—Daniel J. Wu
*Assistant Examiner*—Tai T. Nguyen
(74) *Attorney, Agent, or Firm*—Philip J. Anderson; Anderson & Morishita, LLC

(57) ABSTRACT

A display which provides for the display of a printed media message during daylight hours and an LED message during evening hours. The display can be remotely reconfigured to change and monitor the LED message.

12 Claims, 7 Drawing Sheets

DISPLAY BOARD HAVING ILLUMINATED ELEMENTS AND METHOD

FIELD OF THE INVENTION

The present invention relates to light emitting diode display boards and billboards. This application claims benefit of Ser. No. 60/161,683 filed on Oct. 26, 1999.

BACKGROUND OF THE INVENTION

Billboard signs and the like are well known. For example, for a billboard, a surface of, for example, a standard fourteen feet by forty-eight feet is presented to receive print advertising media, although boards of 10×20, 12×16, 18×24 and 40×60 are used as well. This media, in the past, was printed on a paper stock and then adhered to the surface with a suitable glue. To change the message, the old printed paper stock message panels are removed and a new presentation adhered over the surface. Sometimes the new presentation was/is adhered directly over the old message.

Modernly, the messages are still printed on paper or on a polymer substrate which may be separately framed in component units and secured in the field to the billboard or adhered to the billboard surface.

Billboard companies receive revenues from the display of printed media by advertisers typically based upon a monthly fee.

In the sign art, it has also been known to provide light emitting diode (LED) displays. These displays are expensive; but can be operated to provided animated and video displays. Each picture element, or "pixel", for the display includes a plurality of LEDs defining a cluster, with or without a lens, which, when each diode of the cluster is selectively energized and contrasted, produces a desired pixel color. The combination and patterns of pixel colors in the display cluster matrix produces the desired image. In most cases, a minimum of three diodes of red, green and blue are used. More diodes can be used in the cluster to increase brightness. Since these displays are often used in outdoor environments, to provide the desired effect to be viewed by observers during daylight hours where natural, ambient light may be strong, the pixels must be closely spaced and more diodes must be used at each pixel to provide the brightness and contrast necessary to over come ambient light. The close spacing provides for a fairly continuous image. Further, the close spacing and multiple diodes enables the clusters to work together to produce the brightness necessary to overcome, natural or environmental ambient light so that the image is clearly seen even during daylight hours. This requirement of tightly packed clusters (i.e. pixels) and multiple diodes of colors for each pixel as well as the necessary hardware, wiring and software and cooling requirements contributes to the high costs of outdoor LED displays.

An advantage provided by LED displays is that the message can be changed and/or can be animated through connected computer controls. Thus revenues for advertising can be increased by providing for multiple advertising messages. In Las Vegas, for example, large hotel and casino resorts use LED signs to provide messages to promote their resorts such as attractions, room availability, restaurant information and entertainment and can also post advertising of others to obtain revenues to help defray the acquisition and operational costs of the sign.

While the spacing of pixels could be increased or duplicate color LEDs removed from clusters, the clarity and ability to view the message particularly during conditions of strong ambient light such as outdoor signs during daylight hours would suffer and the image would be undesirable.

There is a need for a sign which provides the benefits of LED signs at a lesser expense by spacing the pixels at greater distances or at only selected portions of a sign, providing, as a trade-off, that the LEDs will not be used to display any primary messages during those operational periods where ambient light is such that, taking into account the spacing or cluster diode count, the message could not be easily viewed. During those hours when the message is not being conveyed by LEDs it would be advantageous to provide a sign which still has the ability to convey a message or wherein the LEDs can accent the message.

SUMMARY OF THE INVENTION

There is, therefore, set forth according to the present invention a display which overcomes the problems associated with prior LED signs, which provides for displaying of multiple messages, which provides for a reduced cost sign and which provides for remote control, operation and confirmation of the operation of the display.

Toward this end a display is set forth board for displaying a first message visible under conditions where ambient light illuminates the display and a second message when ambient light is insufficient to illuminate the display which includes a panel defining a substrate to removably support printed advertising media conveying the first message. These media may be paper, fabric or polymeric or vinyl sheets printed with a message such as an advertisement. A plurality of light emitting diode (LED) clusters are disposed on the substrate and adapted to emit light when energized. Each cluster penetrates the print advertising layer to be exposed at said outer surface. For this purpose, the panels may have openings fashioned therein in a pattern to register a cluster through each opening to be exposed at the outer surface. Means for energizing each cluster are provided as well as means for controlling the energizing of the clusters to create said additional or second message are provided. The penetrations for the LEDs do not interfere with the printed, daylight, image.

During ambient light conditions deemed inappropriate for operation of the LEDs to produce a visible message, the printed message media conveys its message to passers by. If desired, the LED matrix can be disposed and operated to enhance the printed image such as by providing a "twinkling", background or other enhancements to the primary, printed message or its included background.

When ambient light permits, e.g. dusk to dawn, the LEDs are energized to produce the second, additional, image. Since the LEDs and their array during these low ambient light conditions need not overcome strong ambient light, the clusters may be suitable spaced at greater distances and contain a lesser count of color LEDs than would be necessary for a daylight operational LED sign thereby decreasing the cost of the sign and maximizing the effectiveness of the LED message.

To control the operation of the LEDs the controlling means preferably includes a processor controller. The controller may be controlled or programmed at the sign or remotely though telephone lines, a dedicated telecommunication line, satellite networks, cable or other communications link.

In another aspect, the LEDs are mounted in clusters which provide the support to mount the face of the display and which are shielded and have a tilt to increase the effectiveness of the LEDs.

It is a feature of the present invention to produce a display having LEDs which is less expensive than purely LED display boards.

It is another feature to provide a display which presents a first message defined by printed material during high ambient light conditions and a second, LED created message during low ambient light conditions.

It is another object to provide during daylight hours, LED enhancements to printed signage.

It is still another feature to provide a display wherein the LED second message can be remotely configured and monitored.

BRIEF DESCRIPTION OF THE DRAWINGS

These and other features and advantages will become appreciated as the same becomes better understood with reference to the description, claims and drawings wherein:

DESCRIPTION OF THE INVENTION

Figure 1A:
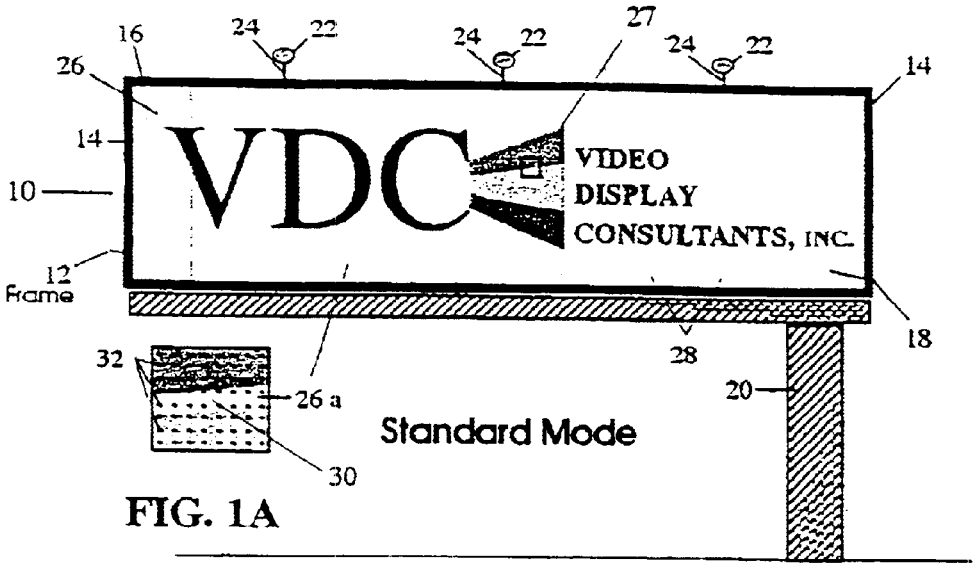
FIGS. 1A–1C illustrate the display of the present invention during periods of daylight hours without enhancements, with daylight enhancement and during evening hours.
Figure 1B:
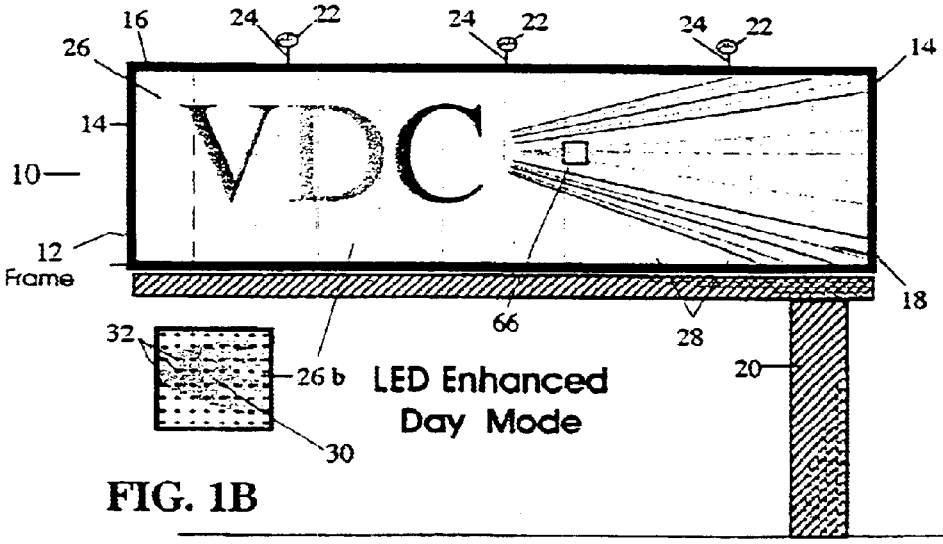
Figure 1C:
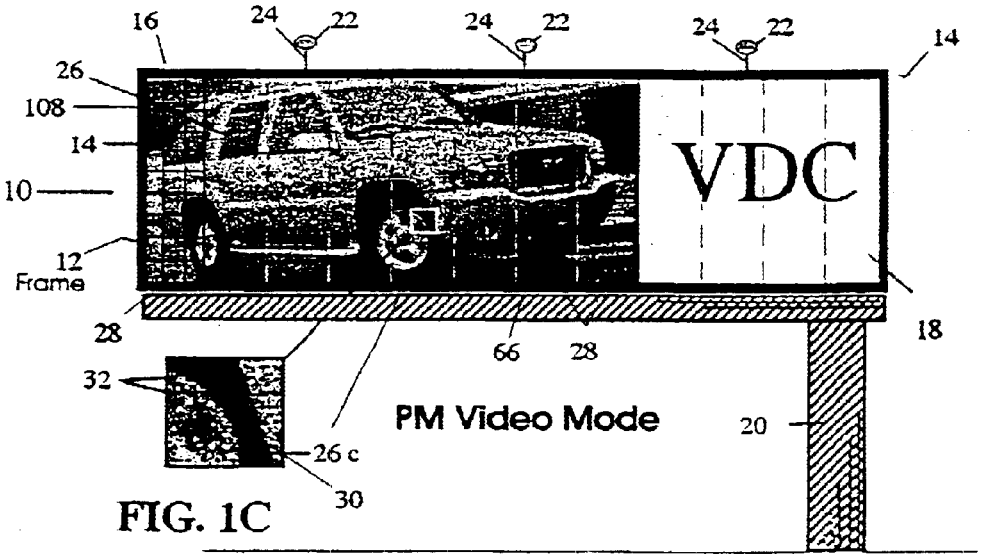

Turning to FIGS. 1A–C a display 10 according to the present invention is shown embodied as an outdoor billboard display. While the following description is directed to an outdoor billboard display, it is to be understood that the display 10 can be a display or sign for any environment which operates under conditions of high ambient light and low ambient light. By high ambient light what is meant is ambient light conditions such as daylight sunshine or other situations such as artificial light, given the construction of the display 10 and the arrangement of LED clusters as described below, which would tend to wash or obscure the LED displayed message. By low ambient light means those conditions under which, given the construction of the display 10 and LED matrix as hereinafter described, the LED created message can be viewed.

The display 10 has a frame 12 which may be fashioned as a substantially closed, flat, rectangular box structure having sides 14, a top 16, bottom, back and front 18. When the display 10 is adapted to operate as an outdoor sign, the frame 12 is supported above the ground on a pillar 20. Alternatively, the display 10 may be hung on a wall or other suitable structure.

To provide external lighting of the front 18 of the display 10, a plurality of electric lights 22, as is known in the art, disposed on arms 24 are provided.

With continuing reference to FIGS. 1A–C, the display 10 during high ambient light conditions is adapted to support and display printed media advertising 26 shown as a printed message "VDC Video Display Consultants" with a rainbow pattern 27. This print advertising, as is known in the art, may be printed on paper stock, vinyl, plastic or any other material as is desired and suitable for the application. As is also known, advertising 26 may, from time to time, be changed by removing the old advertising and putting up the new advertising 26 or simply putting the new advertising 26 over the old. The advertising 26 is, in some cases, printed in strips which are assembled in the field akin to hanging wallpaper, to the front 18.

Figure 5A:
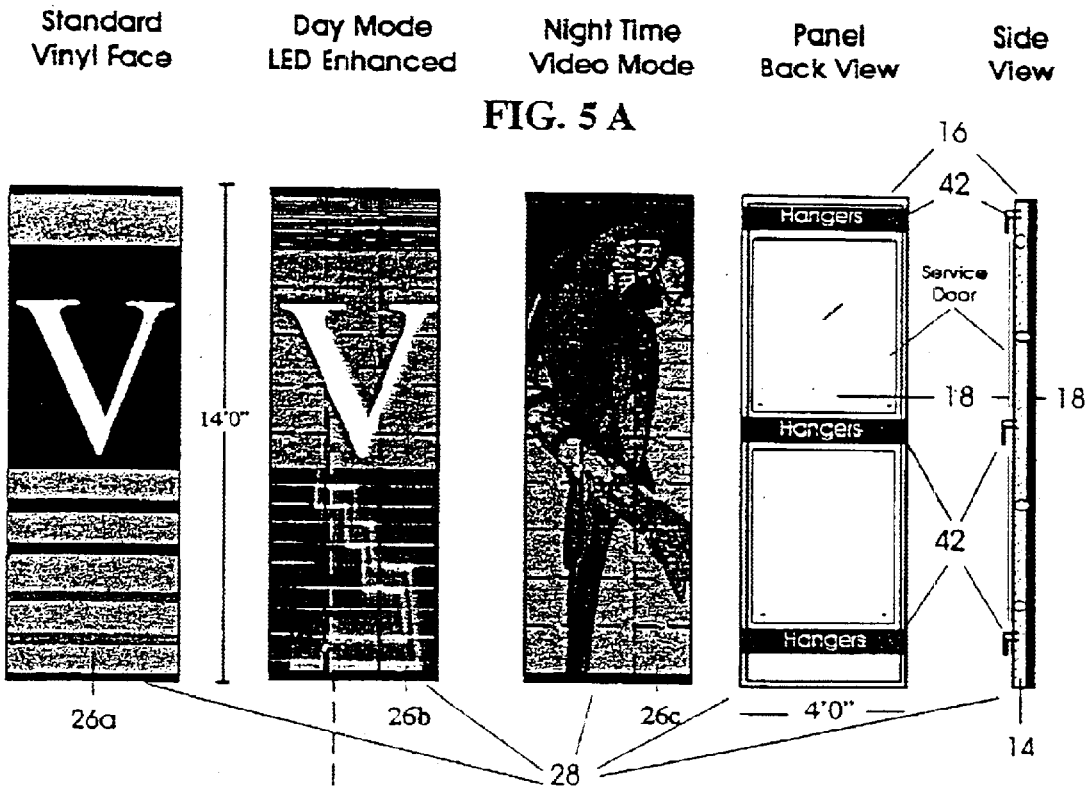
FIG. 5A shows the face, back and side of panel of the display according to the present invention in operation.

The front 18 of the display 10 may be continuous over the length and width of the display 10 which may be fourteen feet by forty-eight feet or may be embodied as a plurality of panels 28 (FIGS. 2, 5A, B) secured to the frame 12. As but an example, each panel 28 may correspond to the width of strips of typical advertising print media. As shown in FIG. 5A, the advertising 26 may be printed on strips 26*a* secured to each panel 28.

As is well known, the print advertising 26 can be viewed during those periods of high or relatively high ambient light conditions such as daylight hours between sunrise and sunset. During evening hours, however, the print advertising 26 cannot be viewed due to the absence of sufficient ambient light. During those hours, if desired, lights 22 may be operated to illuminate the print advertising 26.

Figure 2:
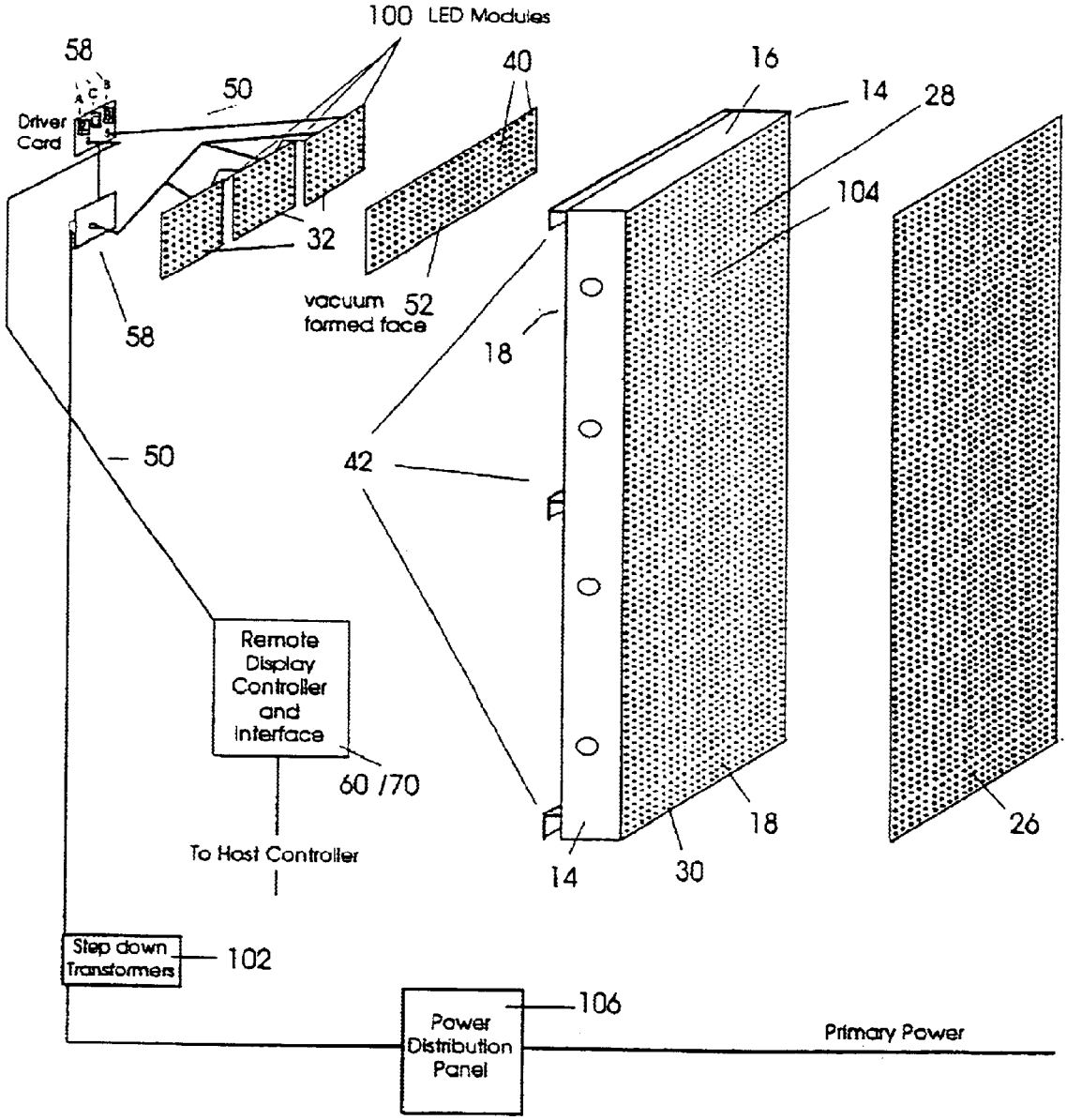
FIG. 2 shows the construction of a panel for the display of FIGS. 1A–1C.
Figure 3:
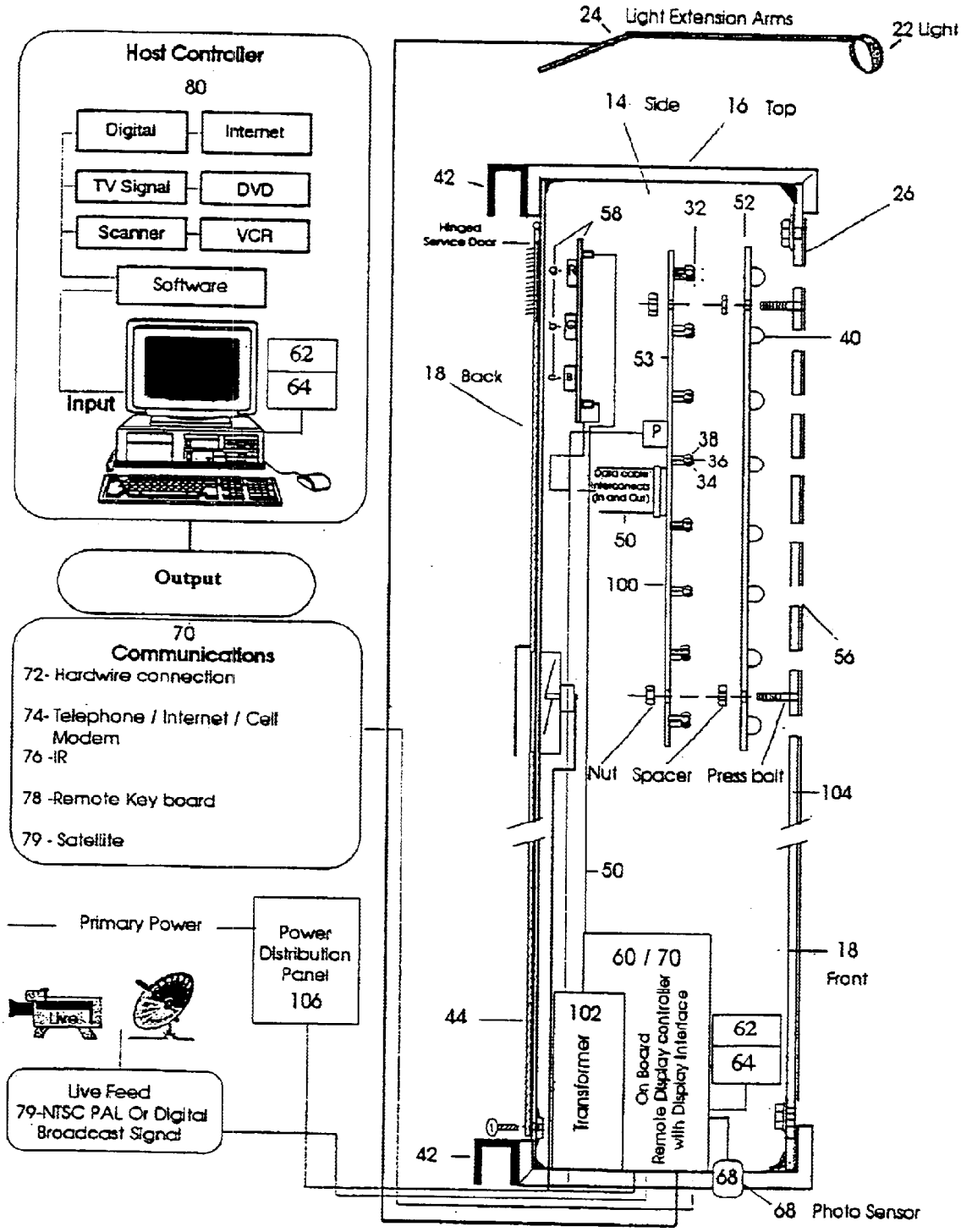
FIG. 3 is a side, assembly, view of a panel for the display as well as illustrating the control and power for the display.
Figure 5B:
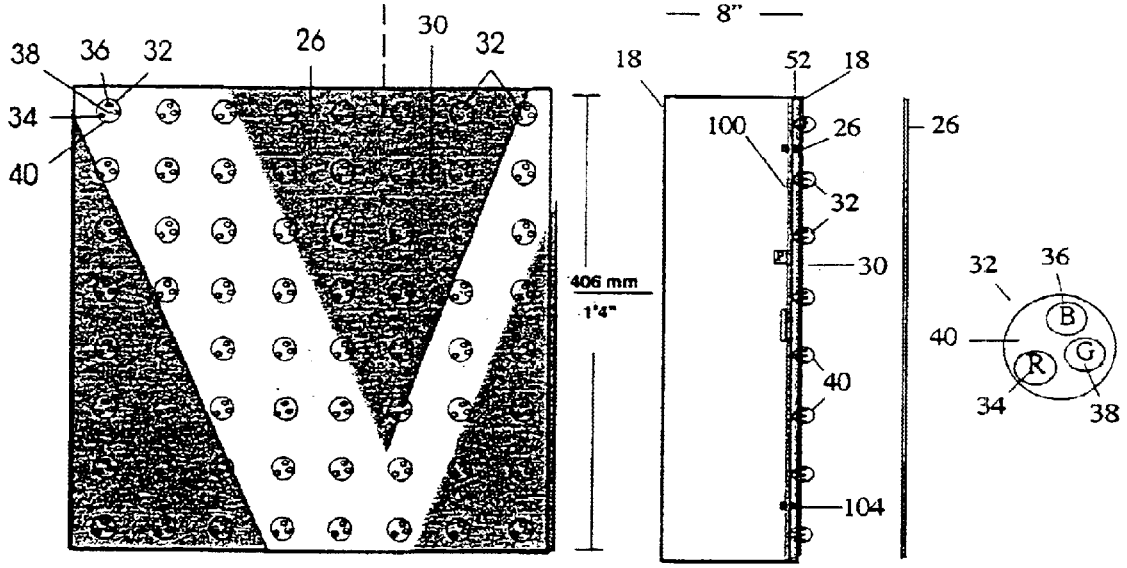
FIG. 5B shows an enlarged front and side view of a portion of a panel for the display as well as an LED cluster.

According to the present invention, to provide for messages different from or to enhance the print advertising 26, each panel 28 includes an array or matrix 30 of light emitting diode (LED) clusters 32 some of which are shown in the broken away, enlarged view in FIG. 1A and shown in FIGS. 2, 3 and 5B. While only some the clusters 32 are shown, it is to be understood that the matrix would include columns and rows of clusters 32. While the following description is directed to a continuous matrix 30 arrangement of clusters 32 for each panel 28 and therefore across the front 18 of the display 10, it is to understood that only portions of one or more panels 28 may include clusters 32 for purposes of which will hereinafter become evident.

With reference to FIG. 5B, each cluster 32 includes one or more of a red light emitting LED 34, a green light emitting LED 36 and blue light emitting LED 38 disposed in a close arrangement. As is known, when the LEDs 34–38 are energized, each emits their respective color light in an intensity dictated by the power supplied thereto. By varying the power, each color may be contrasted as is well known and as is described in Kashiwabara, et al U.S. Patent 5,164,715 the disclosure of which is hereby incorporated by reference. The LEDs 34–38 are clustered behind a protective, transparent lens 40 which may be cylindrical, spherical, pyramidal, triangular or any other desired shape and incorporated into a cover sheet 52 (FIG. 2) fashioned from a transparent plastic material suitable for the application. That is, if the display 10 is for outside use, the cover 52 would be suitable for outside use and be able to withstand the weather and UV light.

Figure 6:
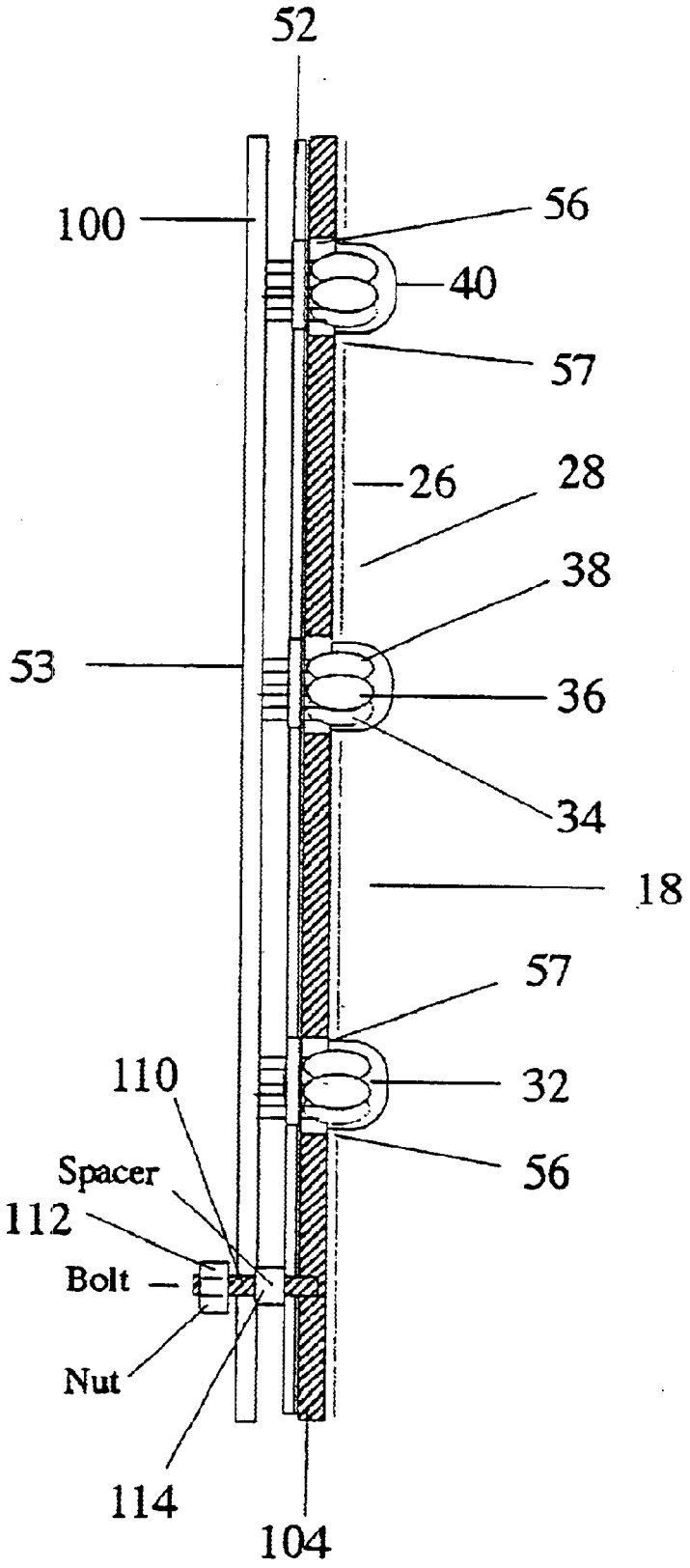
FIG. 6 shows an enlarged view of a portion of the display.

Each cluster 32 as shown in FIGS. 3 and 6 is secured to a mounting board 53 to define the LED matrix 30. It is to be understood that the spacing of clusters 32 in the matrix 30 is greater than would be necessary for a strictly LED display sign in that, as described below, the LED driven display does not have to generate a complete image which overcomes daylight ambient light conditions. As but an example, the LED clusters 32 may be spaced, for a billboard application, between 1.5 and 6 inches apart in the matrix 30.

With reference to FIGS. 2, 3, 5B and 6 each panel 28 includes mounts 42 to secure the panel 28 to the frame 12 of the display 10. The mounts 42 are coupled to a substrate 44 which provides rigidity to the panel 28 and may also define the back for the display 10. The substrate 44 supports one or more LED driver modules 100 which include drivers 58 to drive and control each of the red, green and blue LEDs 34, 36 and 38. The drivers 58 are electrically coupled to each LED cluster 32 for control of the LEDs 32, 34 and 36. A power supply 102 supplies power to the drivers 58 and the clusters 32 for operation thereof.

Defining the front 18 is a perforated face 104 for the display. The perforations or openings 56 are spaced to receive the lenses 40 of the cover 52. As can be appreciated the openings 56, lenses 40 and clusters 32 are all positioned such the lenses 40 pass though the openings 56 and the clusters 32 are located behind the lenses 40. The advertising 26 also includes holes 57 which register with the openings 56 to accommodate the lenses 40. The layer of print advertising 26 is adhered over the face 104. Alternatively the print advertising 26 may be secured to a rigid or semi-rigid carrier sheet adhered to the face 104.

Figure 4:
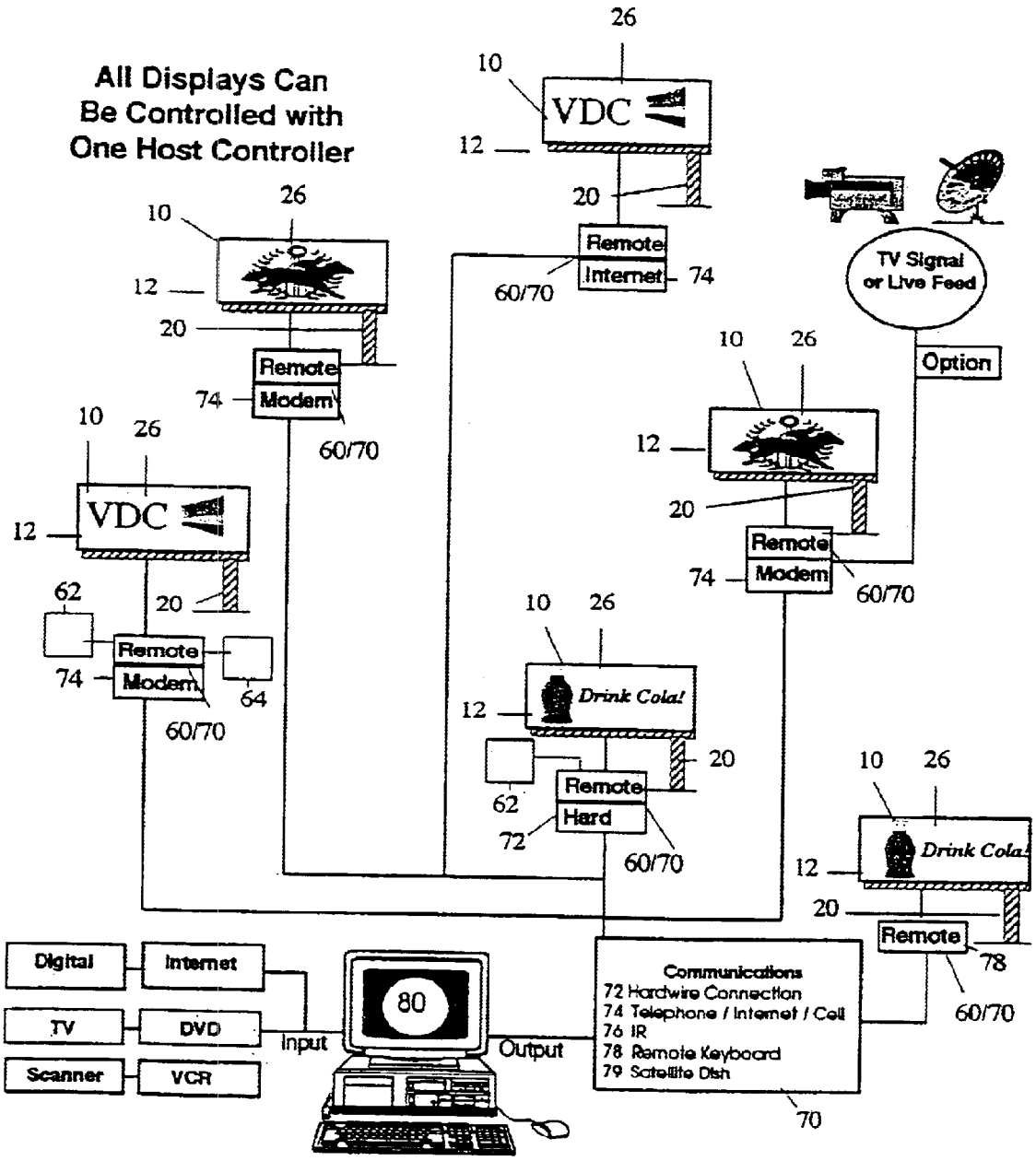
FIG. 4 illustrates the control and operation of the display according to the present invention.

Turning to FIGS. 2–4, the control system of the display 10 is shown. The LEDs 34–38 are powered and controlled by drivers 58 which, in turn are controlled by a local controller 60 disposed within the frame 12. Power is supplied to the local controlled from the power supply 102 which, in turn, is powered from a local power distribution panel 106. Thus, under control of the drivers 58 and local controller, each driver 58 at times and in amounts controlled by the controller 60 is operated to cause each to emit their respective color in the desired contrast to produce, for the cluster 32, the desired color.

To control the clusters 32 of the matrix 30 of the panels 28 of the display 10 to produce the desired image or message in the desired colors, the local controller 60 includes a first memory or data structure 62 which stores fixed parameters for the operation of the system and clusters 32 such as contrast versus power levels, register locations for each cluster 32 and the like. The system also includes a re-writable memory, or second data structure 64 which is adapted to store data to control the clusters 32 to produce the desired color image or message. As but an example, and with reference to FIG. 1B, the second data structure 64 may store data to energize clusters 32 in the matrices 30 to produce a daylight (high ambient light conditions), message enhancing, background of colored beams (LED message 66) streaming across the rainbow 27 form the "VDC" logo to the right on the advertising 26. With reference to FIG. 1C, during evening hours of low of low ambient light conditions, the clusters 32 are energized to produce an image different from the print advertizing 26 shown as a static, color, LED message 66 of a vehicle (sport utility vehicle), a video of the vehicle or other animated advertising. Thus, when the second data structure 64 is accessed and the clusters 32 powered and controlled, the controller 60 energizes the corresponding LEDs 34–38 of the appropriate clusters 32 to produce the LED message 66. In as much as during low ambient light conditions, e.g. at night time, the light from the clusters 32 would wash out the print advertising 26 such that the message 66 is visible.

The controller 60 may also control the lighting of the external sign lights 22 to light the print advertising 26 if desired, such as to alternate during evening hours with the LED message 66.

A photo sensor 68 may be provided which provides input to the local controller 60 concerning ambient light levels. During daylight hours where the ambient light is above a selected threshold level, the local controller 60 does not energize the LEDs 34–38 recognizing that the LED message 66 could not be easily viewed. When the photo sensor 68 determines that the ambient light is below the threshold, the LED message 66 is displayed. Alternatively, during high ambient light conditions, only those programs which enhance the print advertising 26 may be accessed and initiated.

Since the second data structure 64 can be re-written, the LED message 66 can be changed as desired. For example, the "vehicle" message may be run for four consecutive evenings and later replaced by another message. To change the second data structure 64 and to re-program the local controller 60 if desired, an interface 70. The interface 70 which may be embodied as a modem, provides for an operator to gain access to the local controller 60 and data structures 62, 64 to reconfigure the system and to re-write the first or second data structures 62, 64. The interface 70 may be accessed by a hard connection 72 such as a cable connection at the rear of the display 10 whereby an operator using an interface device such as a laptop computer can access the system for reconfiguration. Additionally or alternatively, the display 10 control system may be accessed through a telecommunications line 74 such as a telephone line, cable, Internet connection, local or wide area dedicated network or the like. Thus, from a remote location, the system can be reconfigured to change the LED message 66. Additionally or alternatively, the system may be reconfigurable by an infrared connection 76 whereby the system can be reconfigured by infrared communication using a hand held device by an operator pointing the device at the display 10. At 79 there is shown a remote connection which could be via satellite or the like to reconfigure the display 10.

As shown in FIGS. 3 and 4 the local controller 60 may be re-programmed and accessed via any one, some or all of the above identified means by a host controller 80. The host controller 80, which may be a remote personal computer, is adapted to format and download to the local controller 60 the various media formats for controlling the LED message 66. As shown the display 10 may be controlled to not only enhance the print advertising 26, but to, for example, control the display to produce during low ambient light conditions, a fixed or static LED advertisement such as "Drink Cola", with perhaps a moving background, a live video feed from a satellite, cable, or broadcast source of live video such as a sporting event or the like, from a message stored on video, scanned into the host controller 80, a television feed, from the Internet or stored in memory, digital video disk or floppy disk. Thus from any one or more of these sources the LED component of the display 10 can be controlled to produce the desired LED message or enhance a print message. As shown in FIG. 4, the host controller 80 can access digitally acquired and stored images, television (live or taped) feeds, scanned images, data and images downloaded from the Internet and/or data and images stored on a digital video disk (DVD).

In addition to being able to reconfigure the LED message 66 and other operating parameters of the display 10, the interface 70 also permits the display 10 operator/owner to confirm that the LED message 66 has been displayed as well as the date, time and duration of the message. Thus, for billing purposes to its advertisers, the owner/operator of the display can confirm that the message was displayed. For example, through an internet connection, the controlling data from the controller 60 may be transmitted to a host computer 80 with data identifying the display 10 where the date, time and duration of the LED message is stored and can be retrieved to reproduce the displayed message at a video terminal at the host computer. Thus, if an advertiser wishes to confirm that the LED message 66 was displayed, the host computer 80 can retrieve the data and display it for the advertiser. Further, the connection enables the owner/operator of the display 10 to confirm that the display 10 is operating. If LEDs 34–38 become inoperative, this information is transmitted to the host computer and the display 10 can be serviced.

Still further, the internet connection enables the owner/operator of multiple displays 10 perhaps in different geographic locations, to offer to advertisers multi-regional if not national advertising. From the host computer, times can be coordinated and controlling signals sent to each display 10 to display the desired LED messages 66 for the advertiser. In this regard, since the advertising 26 is provided on the panels 28, the panels can be removed and moved to different location as desired by the advertiser.

As can be understood, the LED message 66 is typically displayed during low ambient light conditions such as evening hours since the clusters 32 are spaced and powered so as to be inadequate to produce during high ambient light conditions, a message which can be discerned by viewers. While the spacing of the clusters 32 decreases the cost of the display 10, the trade-off is that the LED message 66 will not be the primary media during high ambient light conditions.

However, if desired and during high ambient light conditions, certain clusters 32 may be energized to provide color accent or background or movement to the print advertising 26. This accent may be intermittent as desired.

With reference to FIG. 5A a panel 28 is shown in daylight as a standard vinyl face, in a daylight enhanced mode where the clusters 32 are energized during high ambient light conditions, or conditions where the advertising 26 is lighted by the lights 22 to show, for example, background graphics, and in a night time video mode showing, for example, a moving parrot. In FIG. 5B, a portion of a panel 28 is shown enlarged to illustrate the matrix 30 of the clusters 32 as well as an enlarged view of a cluster 32.

With reference to FIG. 6 a further enlarged view of a potion of a panel 28 is shown. As can be appreciated, the lenses 40 of the cover 52 penetrate through the openings 56. The mounting board 53 may be secured to the face 104 by bolts 110, nuts 112 and spacers 114 as suggested in FIG. 6.

Figure 7:
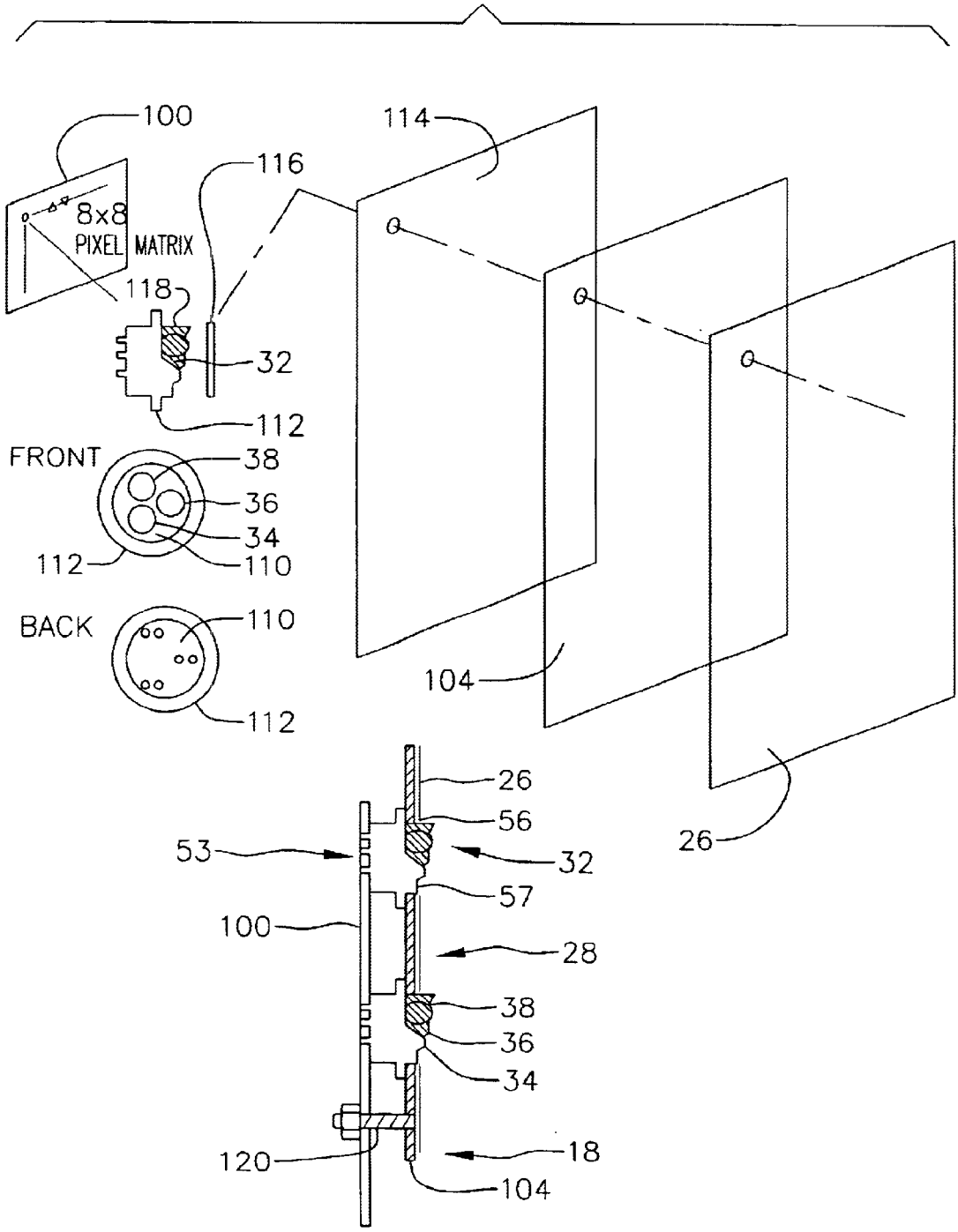
FIG. 7 illustrates a further embodiment of the present invention.

Turning to FIG. 7, a further embodiment of the present invention is shown. According to this embodiment, each LED cluster 32 includes the three LEDs 36, 38 and 34 secured to a rigid base 110 which may be molded plastic or the like. The LEDs 34, 36 and 38 are preferably sealed to the base 110 to prevent moisture from entering through the base 11. The base 110 includes has a flange 112 which supports the rear of the face 104 spaced from the driver modules 100 coupled to the LED clusters 32 while the LEDs 34, 36 and 38 are exposed through the face 104. An optional gasket 114 may be disposed between the flanges 112 and face 104 to define a seal there between. An o-ring 116 between each of the flanges 112 and gasket 114 to further seal the coupling of the LED clusters 32 through the face 104.

Each LED cluster 32 includes a shielding hood 118 in the form of a truncated cylinder. The hood 118 is preferably opaque to shield the LEDs 34, 36 and 38 from above directed light such as sunshine.

Also preferably, the LEDs 34, 36 and 36 and hood 118, relative to the flange 112 (which for most applications such as an outdoor sign will have a substantially vertical orientation) at about a five degree downward tilt. The tilt is preferably imposed when the LEDs 34, 36 and 38 are mounted to the base 110. Thus, relative to a vertical face 104, the LEDs 34, 36 and 38 and hood 118 will have a five degree downward tilt. The use of the hood 118 and tilt of the LEDs 34, 26 and 38 enhances the brilliance of the LED image during periods of higher ambient light.

It should further be noted that the LED clusters 32 and flanges 112 provide mounting surfaces to mount the face 104 in a spaced relationship relative to the driver modules 100 for cooling. A nut and bolt fasteners 120 secure the coupling between the modules 100 and face 104.

While I have shown and described certain embodiments of the present invention, it is to be understood that it is subject to modification without departing from the spirit ans scope of the appended claims.

I claim:

1. A display board for displaying a first message visible under conditions where ambient light is to sufficient illuminate the display and a second message when ambient light is insufficient or to enhance the first message comprising:

a panel defining a substrate to support a material layer, said layer having an outer surface displaying the first message;

a plurality of light emitting diode clusters, each cluster penetrating said material layer to be exposed at said outer surface and said diode clusters angled with respect to said substrate;

means for energizing and controlling the energizing of the clusters to create said second message.

2. A display board for displaying a first image visible under conditions where ambient light is to sufficient illuminate the display and a second image when ambient light is insufficient or to enhance the first image comprising:

a panel defining a substrate to support a material layer, said layer having an outer surface displaying the first image;

a plurality of light emitting diode clusters, each cluster disposed to penetrate said material layer to be exposed at said outer surface at a position in front of said material layer;

means for energizing and controlling the energizing of the clusters to create said second image to display said second image.

3. The display board of claim 2 comprising said controlling means is a processor to control the energizing means to energize said clusters to create said second image.

4. The display board of claim 3 comprising means for remotely configuring said processor to control said energizing means to energize said clusters to create a different second image.

5. The display board of claim 2 comprising said controlling means configured to control said clusters to create said second images as a video sequence of displays.

6. The display board of claim 2 wherein said clusters each adapted to emit light in a desired color to create said second image in color.

7. A sign system comprising:

a sign face with an outer surface and an inner surface, said outer surface being positioned to be seen by observers and said outer surface having a printed first image for viewing by observers;

an aperture matrix formed in said sign face, said aperture matrix being formed of a plurality of spaced apart apertures each of which extends through to said outer surface and said first image;

an LED circuit board positioned proximate said inner surface, said LED circuit board being configured for the mounting of a plurality of light emitting diodes thereto and for the delivery of power to each of said light emitting diode;

an LED array comprised of a plurality of light-emitting diode clusters each mounted to project through said sign face to a position in front of said first image;

a power supply connected to receive power from an external source and to supply power to said LED circuit board and said clusters;

selective control means connected to said LED circuit board to activate selected light-emitting diode clusters of said LED array to present a second image visible by an observer at a luminescence selected to inhibit observation of said first image in low ambient light conditions.

8. The sign system of claim 7 comprising means for remotely interfacing with said selective control means to remotely control activation of said clusters.

9. A display board for displaying a first message visible under conditions where ambient light is to sufficient illuminate the display and a second message when ambient light is insufficient or to enhance the first message comprising:

a panel defining a substrate to support a material layer, said material layer having an outer surface displaying the first message;

a plurality of light emitting diode clusters disposed on the substrate and adapted to emit light when energized, each cluster penetrating said material layer to be exposed at said outer surface and said diode clusters angled with respect to said substrate;

means for energizing and controlling the energizing of the clusters to create said second message.

10. The display of claim 9 wherein each of said clusters further includes a light shielding hood.

11. A method for presenting a printed first sign image viewable in conditions of high ambient light and a second image to enhance said first sign image during conditions of high ambient light to enhance said first sign image or to present said second image during conditions of low ambient light to wash out said first image, said method comprising:

providing a matrix of apertures though at least a portion of said first sign image;

extending though each aperture a LED diode cluster to position said cluster in front of the first sign image;

energizing said clusters to (1) during conditions of high ambient light to enhance said first sign image or (2) to present said second image during conditions of low ambient light to wash out said first image.

12. The method of claim 11 comprising remotely controlling said clusters.

* * * * *